United States Patent [19]

Bartlett

[11] Patent Number: 4,819,712

[45] Date of Patent: Apr. 11, 1989

[54] METHOD AND APPARATUS FOR CONTINUOUS CASTING OF MOLTEN METAL

[75] Inventor: Edwin S. Bartlett, Worthington, Ohio

[73] Assignee: Battelle Development Corporation, Columbus, Ohio

[21] Appl. No.: 165,931

[22] Filed: Mar. 9, 1988

Related U.S. Application Data

[63] Continuation-in-part of Ser. No. 101,525, Sep. 28, 1987, Pat. No. 4,749,024.

[51] Int. Cl.[4] ..... B22D 11/06

[52] U.S. Cl. ..... 164/463; 164/479; 164/423; 164/429; 164/488; 164/439

[58] Field of Search ..... 164/463, 479, 429, 423, 164/488, 437, 428, 480, 439

[56] References Cited

U.S. PATENT DOCUMENTS 4,715,428 12/1987 Johns et al. ..... 164/463
4,749,024 6/1988 Bartlett et al. ..... 164/479

FOREIGN PATENT DOCUMENTS 0147912 of 0000 European Pat. Off. .

*Primary Examiner*—Kuang Y. Lin
*Attorney, Agent, or Firm*—Sidney W. Millard

[57] ABSTRACT

Metal strip may be cast directly from molten metal in an open tundish onto a chill roll. Strip thickness is controlled by contouring the tundish lip with an offset near the casting wheel. This can be used remedially to offset the natural tendency for the strip to be thicker near the edges, which is undesirable for cold rolling, or it may be used creatively to produce contoured strip.

19 Claims, 2 Drawing Sheets

METHOD AND APPARATUS FOR CONTINUOUS CASTING OF MOLTEN METAL

This is a continuation-in-part of application Ser. No. 101,525, filed Sept. 28, 1987, now U.S. Pat. No. 4,749,024.

FIELD OF THE INVENTION

This invention relates to the continuous casting of molten metal on a chilled casting surface.

BACKGROUND OF THE INVENTION

Existing apparatus and methods for continuous casting of molten metal use a tundish for dispensing the molten metal on a continuous casting surface. The casting surface usually comprises a cylinder rotating at a constant speed and located closely adjacent the tundish whereby molten metal flows onto the chilled surface where it freezes. As the solidified metal strip passes over the top of the rotating cylinder it begins to contract transversely and longitudinally, thereby it separates from the casting surface and is thrown out radially therefrom. A conventional casting surface usually includes circumferentially extending grooves because of its beneficial heat transfer characteristics; the reasons for the grooved surface are well known and need not be explained.

One problem which exists with existing apparatus is the "dog-bone" effect. That is, the resulting cast strip includes longitudinally extending bumps or ridges at each side edge of the strip. The bumb or increased thickness of the strip is obviously undesirable because the best strip for subsequent processing is one which is completely flat. The humps at the transverse sides of the longitudinally extending strip occur because of the heat transfer characteristics of the rotating cylinder.

When a steady state casting operation is achieved, the cylinder withdraws heat from the molten metal at a constant rate and dissipates heat from all its surfaces in exact proportion to the amount of heat withdrawn from the molten metal. As will be clear, with a steady state condition the hottest part of the cylindrical casting surface is adjacent the periphery, roughly intermediate the sides of the casting strip and approximately at the point on the surface where the change of phase occurs from the molten metal to the solid state. From that point on the casting surface there is a heat gradient in all directions. The parts of the cylindrical surface which are at the lowest temperature are at the ends wich do not contact the molten metal at all. A temperature profile along the cylindrical surface looks something like a conventional bell-shaped curve. The humps on the side edges of the cast metal result from two directional heat dissipation at the cylinder edges and single directional heat dissipation at the center of the cylinder. At the center of the casting surface the heat dissipation only radially. At the edges the heat flows radially and toward the ends of the cylinder. Accordingly, the temperature of the casting surface at its edges will always be lower than the temperature at the center. Because the cylinder near its ends is at a lower constant temperature it freezes the metal more quickly and pulls a larger volume of metal, hence the undesirable side humps. This undesirable characteristic of the cast metal strip is eliminated to a great extent by the apparatus to be described subsequently.

Another problem existing in apparatus currently in use is type 1 and 2 ripples.

Type 1 and 2 ripples are formed in the cast strip as transversely extending humps of increased metal thickness along the cast strip. Particularly in relation to the casting of aluminum, for example 3105 and 3004 alloys, oxides form on the upper surface of the molten metal in the tundish. From time to time parts of this crust of aluminum oxide break off to be carried along on the upper surface of the alloy as it is drawn from the tundish by the rotating cylinder. The broken aluminum oxide crust seems to drag an increased volume of the melt along with it when it is drawn from the tundish and when it freezes it creates a transversely extending ripple in the outer surface of the cast strip. Whether this ripple, referred to as a type 1 ripple, is caused by surface tension of the crust or a temperature differential between the crust and the melt is not exactly clear. In any case, the type 1 ripples do form and the reason is immaterial to this invention. Ways have been devised for minimizing the detrimental affect of type 1 ripples and that is not a part of the invention described herein.

Type 2 ripples appear to be initiated by some oscillating factor which causes the molten metal to be periodically pushed deeper than normal into the circumferentially extending grooves circumscribing the casting surface. The result is a transversely extending ridge on both the bottom of the resulting cast surface and a corresponding larger bump on the upper surface of the cast strip. It is believed that the bumps on the two surfaces are in register because of the resulting increase in heat transfer between the molten metal and the casting surface. Specifically, when the molten metal is pushed down deeper into the circumferential grooves the increased contact area between the molten metal and the casting surface results in greater heat extraction, thereby solidifying a large thickness of molten metal; the upper surface hump is the result.

This problem of type 2 ripples has been a continuing one and no solution was proposed until a very specific observation was made on a particular feed apparatus. That apparatus includes a series of baffles in the tundish to give a more uniform flow of molten metal to the casting surface. The theory of the baffles is that one should baffle the center of the tundish because it naturally flows too rapidly due to the fact that the sidewalls of the tundish will retard edge flow. The surface at the center of a flowing stream always flows fastest because there are fewer obstructions to retard flow. In observing the specific casting apparatus in operation there appeared to be turbulence in the edge areas of the tundish as the molten metal flowed onto the rotating casting surface and an observation of the resulting cast strip showed type 2 ripples in the central portion of the strip but no type 2 ripples at the margins of the strip. Thus the theory was formed that inducing turbulence into the molten metal adjacent to and prior to the time it contacted the rotating casting surface would eliminate type 2 ripples. Accordingly, the structure of the tundish was modified to increase the speed of the flowing metal as it approached the casting surface and this was accomplished by sloping or curving the edge of the tundish adjacent the casting surface to form a lip. This downward slope increases the velocity of the flowing metal with the assistance of gravity. Further turbulence was induced by placing a transverse horizontal bar in the flow path below the surface of the metal closely adjacent the casting surface. This eliminated the type 2 ripples and it was only after additional testing that it was discovered the turbulence was immaterial and ultimately the rod to induce turbulence was removed as other parameters were discovered which could be manipulated to minimize type 2 ripples.

SUMMARY OF THE INVENTION

A rotating casting surface and a tundish located adjacent thereto are combined in a unique fashion to give a more uniform thickness of cast metal strip, to minimize longitudinally extending ridges near the edges of the strip and to minimize transversely extending ridges in the center of the strip. Structure particularly of significance is the formation of a downwardly sloping or curving lip in the feeding edge of the tundish adjacent the rotating casting surface. The lip is formed at the discharge edge of the floor of the tundish. The sloping surface is non-uniform transversely across the discharge edge in at least some embodiments. That is, in some embodiments the lip forms a 90° arc beginning in the floor of the tundish and curving downward. At the edge portions of the tundish, the arc may be as little as ⅜ inch of an inch in radius whereas in the middle portion of the discharge end of the tundish the slope could be much greater but would again extend through a full 90° arc.

In another embodiment, the arc might be less than 90°, i.e. 70°, depending on other characteristics of the casting operation.

In yet another embodiment, the curved or sloping surface might be uniform completely across the lip from one tundish sidewall to the other.

In a fourth embodiment, where the tundish is lowered to a place where it is about the same elevation as the axis of the rotating casting surface, there may be essentially no curved lip at all.

It is believed that the way to minimize type 2 transverse ridges is to have a great change in flow direction of the molten metal. The change in direction being between the point where the molten metal leaves the surface of the tundish and the point where the molten metal first contacts the rotating casting surface.

Objects of the invention not clear from the above will be fully understood from a review of the drawings and the detailed description of the preferred embodiments which follow.

DESCRIPTION OF THE PREFERRED EMBODIMENT

Figure 1:
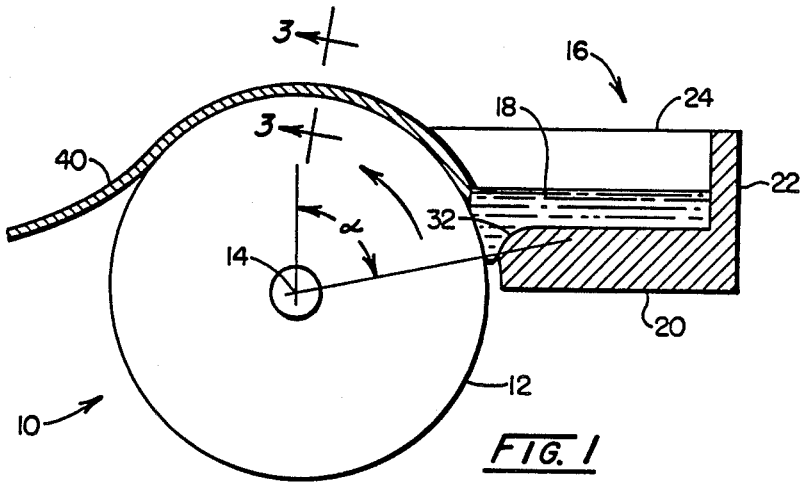
FIG. 1 is a side elevational view partially in section of the rotating casting wheel and liquid metal feeding tundish of this invention.

Looking to FIG. 1, a cylindrical casting cylinder 10 having a peripheral casting surface 12 is illustrated as rotating counterclockwise about a horizontal axis 14. The casting surface 12 is disposed in close proximity to a tundish 16 which holds a body of molten metal 18.

Figure 4:
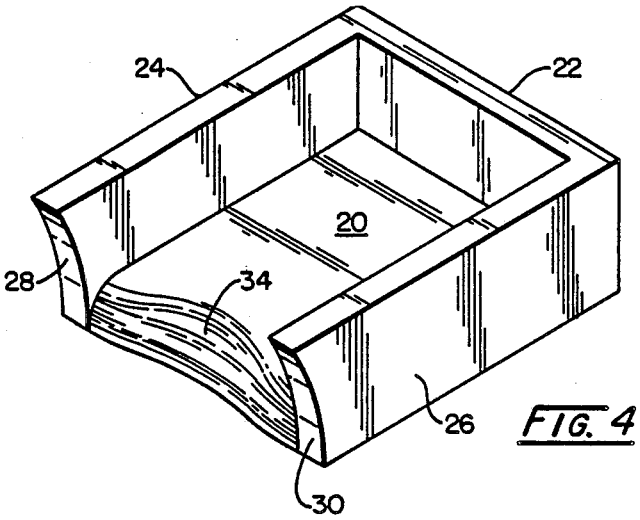
FIG. 4 is a perspective view of one embodiment of a tundish lip according to this invention.
Figure 6:
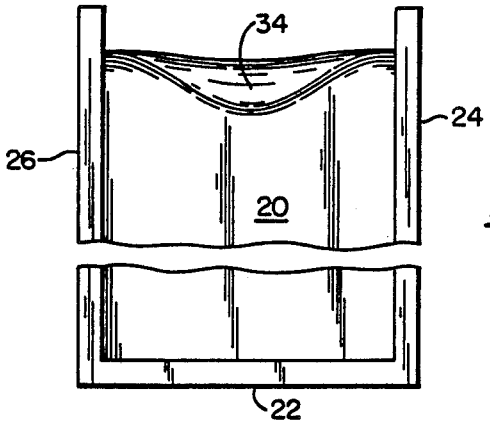
FIG. 6 is a top plan view of the tundish of FIG. 4.

The tundish includes a bottomwall 20, an end wall 22 and a pair of sidewalls 24 and 26, see FIGS. 4 and 6.

An observation of FIG. 4 will show that the forward faces 28 and 30 of sidewalls 24 and 26 are curved to accommodate the cylindrical casting surface 12.

Figure 2:
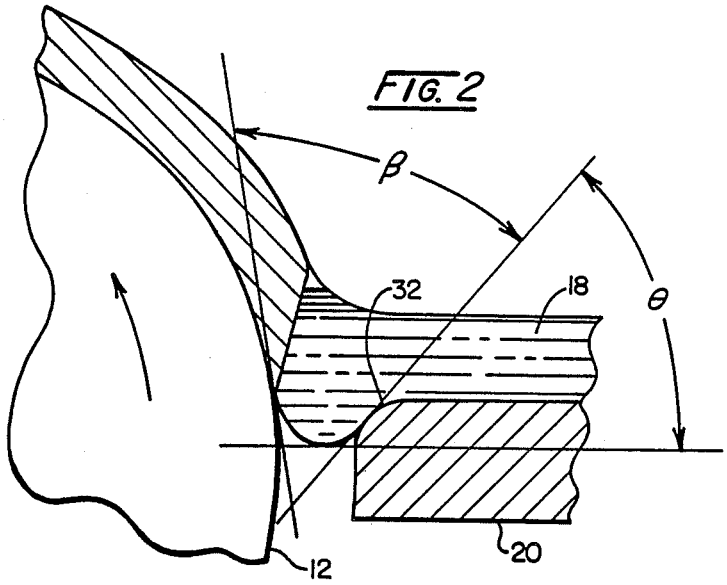
FIG. 2 is an enlarged fragmentary side elevational view of the merger point between the rotating casting surface, the molten metal and the tundish.

Looking particularly to FIGS. 1 and 2, it will be observed that the bottomwall 20 is placed closely adjacent the casting surface 12 but slightly spaced therefrom to leave a gap. The liquid metal flows into this gap to form a downwardly projecting meniscus with the left-hand side of the meniscus shown in FIG. 2 being drawn upward by the upwardly rotating casting surface 12. For reasons which will be explained subsequently, the portion of the bottomwall 20 closest adjacent the casting surface 12 is curved, sloped or chamfered to form a lip 32. The curved, sloped or chamfered surface forming the lip configuration is provided by making the tundish from generally planar pieces and removing a portion of the floor piece to provide an offset from the rotating casting surface. The offset is a part of the downwardly sloping planar or convex profile of the lip. The lip is formed to change the direction of the flow of metal at the lower surface so it will be moving both horizontally and downwardly before it is jerked upwardly by rotating surface 12 to change its direction of momentum by over about 55°. As explained above, the change in direction of the flowing metal is critical to greatly decrease or eliminate type 2 ripples.

There are three angles which will be defined which have significance in minimizing the formation of transverse ridges in the cast strip. Angle $\alpha$ is the angle between a vertical line extending through the axis 14 of the cylinder 10 and another line extending through axis 14 to the point on lip 32 where the liquid metal 18 separates from the surface of the lip. (See FIG. 1).

Angle $\beta$ is the angle between the tangent to lip 32 at the point where the liquid metal separates from the lip and the tangent to casting surface 12 at the point where the liquid metal first engages the casting surface.

Angle $\theta$ is the angle between the tangent to the lip 32 where the liquid metal separates from the lip and a horizontal line.

To be properly functional, angles $\alpha$, $\beta$ and $\theta$ must be acute angles with the possible exception of angle $\alpha$. It may be that the tundish floor could be lowered slightly below a horizontal line passing through axis 14 and still be operational. At that point, $\alpha$ might be about 90°. It is thought possible that the curved or sloped surface 32 forming the lip may be necessary if the angle $\alpha$ reaches about 90°, but in the preferred embodiment $\alpha$ would be between 30° and 60° with the lower end of that range being the more preferred.

It is preferred that the angle $\theta$ fall in the range of about 20° to about 70° and preferably closer to 70°.

The object of the structure described has two very important and distinct benefits to the casting of metal strip. The first reason for the structure is to minimize the "dog-bone" structure or the raised ridges at the side edges of the cast strip. The detailed description of how this works is incorporated in great detail in copending application Ser. No. 101,525, filed Sept. 28, 1987, now U.S. Pat. No. 4,749,024, and to the extent necessary for understanding this feature of the invention the disclosure is incorporated herein by reference.

The other reason for the structure is to minimize the periodic transverse ridges in the cast structure which are commonly known as type 2 ripples. That is accomplished by having an adequate change in direction between the point the liquid metal leaves the surface of the lip 32 and the point it engages the casting surface 12. It is preferred that the change in direction be greater than about 55°, or 180° minus $\beta$.

The curved non-uniform lip 34 illustrated in FIGS. 4 and 6 is one embodiment which would be particularly useful in minimizing the longitudinally extending side ridges discussed above. Note that the discharge edge of the lip 34 is curved rather than a straight line, seen best in FIG. 6. This structure is to assist in balancing the thickness of the cast strip. That is, the curved lip helps minimize the "dog-bone" effect.

Figure 5:
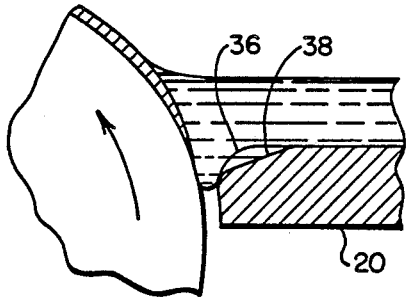
FIG. 5 is a fragmentary side elevational view similar to FIG. 2 but showing alternative lip embodiments.

FIG. 5 shows two alternate lip profiles 36 and 38 which may be used as desired.

In operation, casting surface 12 will rotate about axis 14 while molten metal 18 is fed into tundish 16. As the molten metal flows over lip 32 it will be picked up by the upwardly moving casting surface 12 which will freeze the liquid metal into a strip 40. Strip 40 will separate from the casting surface as it passes over the top of the rotating cylinder.

Figure 3:
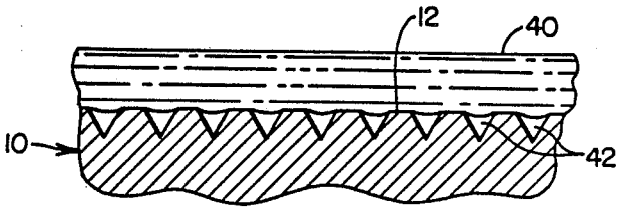
FIG. 3 is a fragmentary sectional view taken along line 3—3 of FIG. 1.

Note FIG. 3 which shows an enlarged sectional view of the casting surface and the cast strip 40. The casting surface 12 includes a plurality of shallow circumferentially extending grooves 42. The purpose of the grooves is well known in the art and will not be described here.

With the proper lip structure 32, 34, 36 or 38 and the proper tundish location with respect to the casting surface, transverse and longitudinal ridges will be greatly minimized in the cast strip 40.

Having thus described the invention in its preferred embodiment, it will be clear that certain modifications may be made to the structure and the procedural sequence without departing from the spirit of the invention. It is not intended that the words used to describe the preferred embodiments nor the drawings used to illustrate the invention be limiting on the invention, rather it is intended that the same be limited only by the scope of the appended claims.

I claim:

1. Apparatus for direct casting of controlled thickness sheet from the melt on a chilled casting surface of the type comprising, a molten-metal-containing tundish including a backwall, opposed sidewalls and a floor therebetween and having the sidewalls and floor closely adjacent and contoured with the chilled casting surface such that a layer of molten metal is delivered over a lip on the tundish to the casting surface during casting, the lip being a portion of the floor adjacent the casting wheel and said lip including an offset away from the casting surface, thus allowing a longer solidification distance of the melt with the casting surface and a consequent thicker sheet in the vicinity of the offset, said lip offset being in the form of a continuously sloping convex surface inclined downwardly from the horizontal, whereas the angle formed between a horizontal line and a line tangent to the lip means at the point where the molten metal separates from the lip means is in the range of about 20° to about 70°, and said lip means being configured to deliver said molten metal by gravity during continuous casting and with a change in flow direction of the molten metal from the point where the molten metal leaves the surface of the means forming the lip to the point said molten metal contacts the casting surface of in excess of about 55°.

2. The apparatus of claim 1 wherein the lip offset is of non-uniform depth from the tundish floor upper surface downward to a point above a lower surface of the tundish floor.

3. The apparatus for claim 2 wherein the lip offset spans substantially the entire width of the tundish between sidewalls.

4. The apparatus of claim 2 wherein the lip offset is of increasing depth from near the tundish sidewalls to near the center of the lip.

5. A method for providing a desired thickness contour across the width of a metal sheet which is cast on a chilled casting surface directly from the melt comprising, providing a tundish containing a pool of molten metal and including a backwall, opposed sidewalls, and a floor therebetween wherein the floor and sidewalls are closely adjacent and contoured with the chilled casting surface such that the casting surface forms a barrier contacting the molten metal pool, removing a portion of the floor adjacent the casting surface including a portion of an upper surface of the floor to form a lip having a downwardly sloping surface in the tundish, said sloping surface being adjacent the casting surface, thus allowing greater depth of contact of the melt with the casting surface to control the sheet thickness profile across its width, moving the casting surface through the melt pool thereby building a solidified layer of metal with the desired thickness contour of the casting surface, adjusting the tundish with respect to the casting surface whereby the angle between a vertical plane through the center of rotation of the casting surface and another plane through the center and the point of separation of molten metal from the lip is in the range of about 30° to about 60° and said lip means being configured to deliver said molten metal by gravity during continuous casting and with a change in flow direction of the molten metal from the point where the molten metal leaves the surface of the means forming the lip to the point said molten metal contacts the casting surface of in excess of about 55°.

6. The method of claim 5 including removing a uniform depth portion of the tundish floor upper surface to form said lip with a uniform convex profile between said sidewalls.

7. The method of claim 5 including removing a non-uniform depth portion from the tundish floor upper surface to form said lip with a non-uniform convex profile between said sidewalls.

8. The method of claim 5 including removing a portion of increasing depth from the tundish floor to form the lip of increasing depth from the sidewalls to near the center of the lip.

9. Apparatus for minimizing transverse ripples in a continuously cast metal strip comprising, a tundish for receiving molten metal and a cylindrical casting surface mounted in operative position adjacent the tundish to receive molten metal from said tundish, said tundish including a floor and vertically extending walls to hold molten metal and means forming a downwardly sloping convex lip in the floor adjacent the casting surface for delivering molten metal from said tundish to said casting surface over said lip means, said lip means being configured to deliver said molten metal by gravity during continuous casting and with a change in flow direction of the molten metal from the point where the molten metal leaves the surface of the means forming the lip to the point said molten metal contacts the casting surface of in excess of about 55°.

10. The apparatus of claim 9 wherein the lip means, in a cross-section perpendicular to said casting surface, defines a continuous convex curve.

11. The apparatus of claim 10 wherein the angle formed between a vertical line through the center of rotation of the casting surface and a line extending from said center of rotation to the point on the lip means where the molten metal separates from the lip means is greater than about 30°.

12. The apparatus of claim 11 wherein the angle formed between a horizontal line and a line tangent to the lip means at the point where the molten metal separates from the lip means is in the range of about 20° to about 70°.

13. The apparatus of claim 9 wherein the angle formed between a vertical line through the center of rotation of the casting surface and a line extending from said center of rotation to the point on the lip means where the molten metal separates from the lip means is greater than about 30°.

14. The apparatus of claim 13 wherein the angle formed between a horizontal line and a line tangent to the lip means at the point where the molten metal separates from the lip means is in the range of about 20° to about 70°.

15. The apparatus for claim 9 wherein the angle formed between a horizontal line and a line tangent to the lip means at the point where the molten metal separates from the lip means is in the range of about 20° to about 70°.

16. The apparatus of claim 9 wherein said cylindrical casting surface includes circumferentially extending grooves.

17. The apparatus of claim 12 wherein said cylindrical casting surface includes circumferentially extending grooves.

18. The apparatus of claim 13 wherein said cylindrical casting surface includes circumferentially extending grooves.

19. The apparatus of claim 15 wherein said cylindrical casting surface includes circumferentially extending grooves.

* * * * *